United States Patent [19]

Jennings

[11] 3,989,212

[45] Nov. 2, 1976

[54] CHAIR AND SUPPORTING BASE FOR A SEAT

[75] Inventor: Roy E. Jennings, Temple, Tex.

[73] Assignee: Royal Seating Corporation, Cameron, Tex.

[22] Filed: Dec. 9, 1974

[21] Appl. No.: 530,946

Related U.S. Application Data

[63] Continuation of Ser. No. 268,808, July 3, 1972, abandoned, which is a continuation-in-part of Ser. Nos. 198,175, Nov. 12, 1971, and Ser. No. 235,673, March 17, 1972.

[52] U.S. Cl. ..... 248/188.9; 16/42 T

[51] Int. Cl.[2] ..... A47B 91/06

[58] Field of Search..... 297/445, DIG. 2, 440; 248/345.1, 188.8, 188.9

[56] References Cited

UNITED STATES PATENTS

| | | | |
|---|---|---|---|
| 2,543,592 | 2/1951 | O'Connor | 248/188.8 |
| 2,588,417 | 3/1952 | Schladermundt | 297/DIG. 2 |
| 2,710,027 | 6/1955 | Husgen | 248/188.8 |
| 2,868,602 | 1/1959 | Drezner | 248/188.8 |
| 3,520,507 | 7/1970 | Strong | 248/188.9 X |
| 3,634,894 | 1/1972 | Harbison | 297/DIG. 2 |
| 3,698,150 | 10/1972 | Anderson | 297/DIG. 2 |
| 3,701,450 | 10/1972 | Belzberg | 248/188.8 X |

*Primary Examiner*—J. Franklin Foss
*Attorney, Agent, or Firm*—Walter Kruger

[57] ABSTRACT

A chair seat and supporting base for the seat, each of which can be of unitary construction. The base is formed from a plastic material and has legs, the side walls of which merge smoothly into depending peripheral skirts of an upper supporting portion of the base. The legs have a plurality of vertical strengthening webs which are unexposed when the base is in its normal upright position. In addition, there is a grid-work of longitudinal and transverse walls each of which is vertical and which provide additional beam strength and rigidity to the base. Several arrangements are provided for securing a seat-back shell to different embodiments of the base. A unique glide arrangement is also disclosed which permits severing the legs at a desired height to provide chairs of different heights while providing a flat floor engaging glide that is secured against removal, for example, by ultrasonically bonding the glide to the foot of the chair leg.

2 Claims, 12 Drawing Figures

CHAIR AND SUPPORTING BASE FOR A SEAT

This is a continuation of application Ser. No. 268,808, filed July 3, 1972 now abandoned, which is in turn a continuation in part of my copending U.S. patent applications, Ser. No. 198,175, filed Nov. 12, 1971, and Ser. No. 235,673, filed Mar. 17, 1972.

This invention relates generally to a chair and particularly to a plastic material base for supporting a seat and wherein the base is formed from plastic material.

Among the features of this invention is a base of unitary construction of plastic material for supporting a seat, a strengthening grid work so a base comprised of thin sections can support reasonably heavy loads, a base which is easy to form, for example, by casting or molding techniques, a unique floor engaging glide which can be ultrasonically welded to the foot of each lag of the base, and a base of unitary construction for supporting a seat wherein the base and seat are so dimensioned and configured that the resulting chairs can be stacked in nested relation to provide for storage and shipping.

Fabricated and composite bases of various types for supporting seats or seat-back combinations are well known in the patented art. Recently, a substantially all plastic seat and base arrangement was developed. In my above identified copending applications, I show and claim a plastic material chair base which is of two-piece construction and I also show and claim a method of making the base. In those copending applications the base parts are secured together in a suitable manner, for example, by ultrasonic welding. The thin sections of the base are reinforced by walls and strengthening ribs to add rigidity and strength to the base.

The present invention relates to a base particularly for a chair which is somewhat similar in that it is formed from plastic material. The present chair base, however, can be of unitary construction and advantageously has a plurality of vertical webs or walls both in the legs and along the upper portion of the base which add rigidity and beam strength to the structure.

While plastic material such as polyethylenes, polyurethenes, polypropylenes, and other plastic molding materials provide advantages such as corrosion resistance, sanitary surfaces, and require no painting so there can be no paint flaking, thin sections of such plastics are flexible and lack the rigidity necessary to form a rigid load supporting structure. In addition, the amount of plastic required to form a chair is substantial, especially where the resulting chair must compete with other types of chairs in the institutional market.

Applicant has recognized, that for a chair to be competitive in this market, it must have sanitation and strength features at least as good as those of the presently available chairs and must, in addition, be competitively priced. In addition, where the chair is to be used in educational institutions, it is necessary to be able to provide chairs of various heights for use by children of different age groups without additional costs. In accordance with one aspect of this invention applicant has found that vertical brace walls within sloping legs of the chair provide the necessary strength and rigidity while permitting severing the legs to a desired length and adding a floor engaging glide. The glide because of its unique construction in accordance with this invention can be added quite economically and is securely held against removal.

In accordance with this invention, it has been further found that a plastic material chair base can be formed from relatively thin sections of ¼ inch or less and can be reinforced with integral ribs, webs, and brace walls which are located on the normally non-exposed underside of the base structure. This permits, in accordance with this invention, the forming of a smooth and attractive exterior surface base having legs with side walls which blend into a peripheral skirt that surrounds the upper portion of the base.

An additional feature of the invention resides in a base construction for supporting an integral seat-back shell and in which the base has supporting ledges along each side which are adapted to engage a downwardly turned peripheral flange of the seat. In aa related aspect of the invention, the ledge forms a continuation of the legs at the same side of the chair which legs are of a downwardly opening U-shaped cross sectional configuration, and the walls of the legs are continuous from for example, a front leg to a rear leg through the region of the ledge. An additional related feature is an intermediate wall or rib within each leg which is located within the confines of the U-shaped configuration of a leg and which extends along each leg and through the region of the ledge.

Accordingly, an object of this invention is a plastic material chair base of unique construction which provides for stacking the chairs in nested relation with minimum space requirements.

Another object is a plastic material base for a chair in which side walls of the legs merge smoothly into the front, rear, and side walls of an upper peripheral skirt of the base.

Another object is a plastic material base of unitary construction which is uniquely adapted to be molded or cast in one piece and in which a grid work of parallel strengthening walls is provided to enhance the strength and rigidity of the resulting chair while allowing a construction of relatively thin walled sections so the resulting chair is inexpensive to manufacture, requires a minimum amount of plastic material, and has a relatively light weight.

Another object is a unitary supporting base for a chair which includes a seat attaching arrangement which permits securing a seat or seat-back combination to the base without the need for separate fasteners by permitting the bonding of sections of the base at locations which are normally obscured from view.

Another object is a unique leg construction wherein the leg is of generally U-shaped configuration, has a central strengthening rib which extends the length of the leg, and has a plurality of strengthening webs which face downwardly relative to the leg and which add twisting and bending resistance characteristics to the leg.

Another object is a chair, with wholly plastic material exposed surfaces in which both the base and seat-back shell are formed from an ultransonically bondable material, the seat is ultrasonically bonded to the base, and plastic material glides are ultrasonically bonded to the feet of the legs.

Another object is a plastic material floor engaging glide of unique construction having upright side walls which engage and are bonded to the side wall of a leg and which has a base pad engaged by an end edge of the leg.

A still further object is a chair construction in which the legs are arranged in pairs, each leg is of U-shaped configuration and has a central longitudinal strengthening rib, and the strengthening rib as well as the side walls which form the U-shaped configuration extends from the foot of one leg, then upwardly along the base, and then downwardly to the foot of a second leg of the pair.

A still further object is a chair construction in which the legs are arranged in pairs, each leg is of downwardly opening U-shaped configuration, and the U-shaped configuration extends from the foot of one leg, then upwardly along the base, and then downwardly to the foot of a second leg of the pair, the portion of the walls which extend along the base forming a supporting ledge for a side flange of the chair seat which is mounted on the base.

Numerous other features, objects, and advantages of the invention will become apparent with reference to the accompanying drawings which form a part of the specification and in which.

Figure 2:
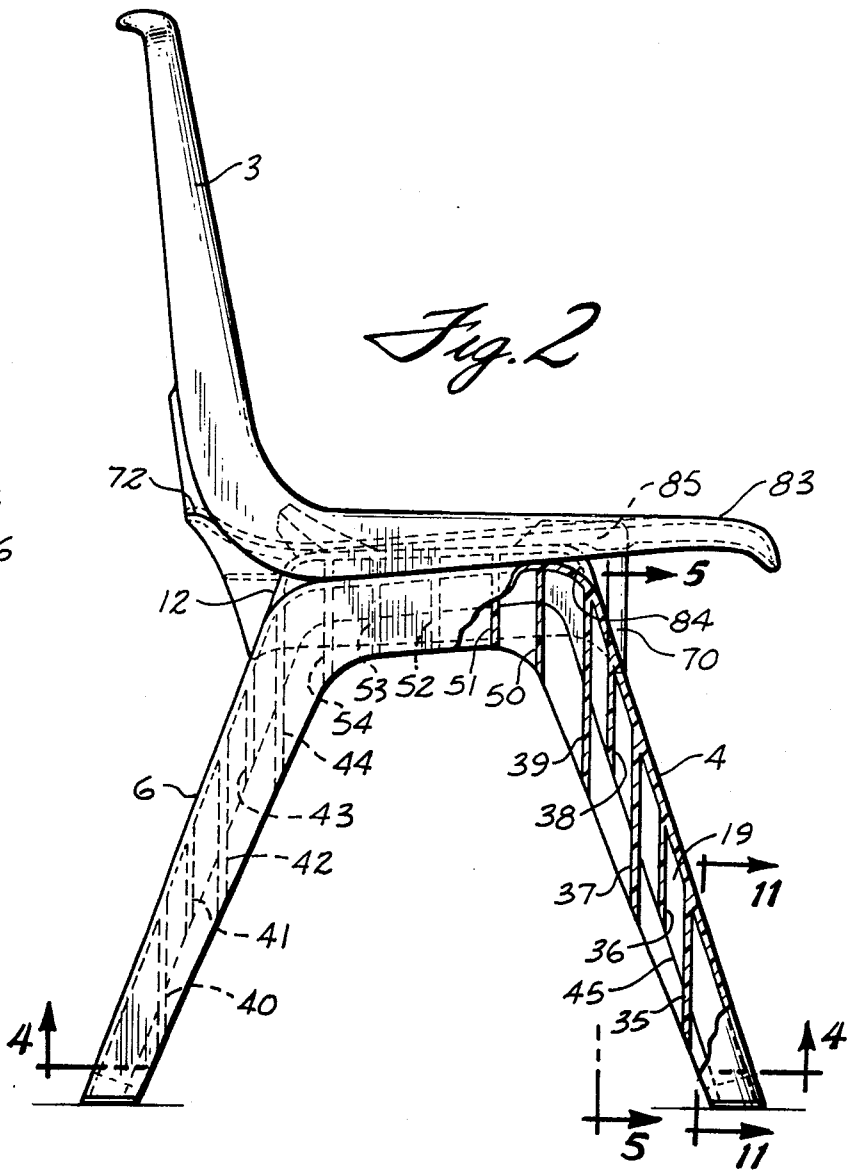
FIG. 2 is a left hand side view in elevation of the chair of FIG. 1.
Figure 1:
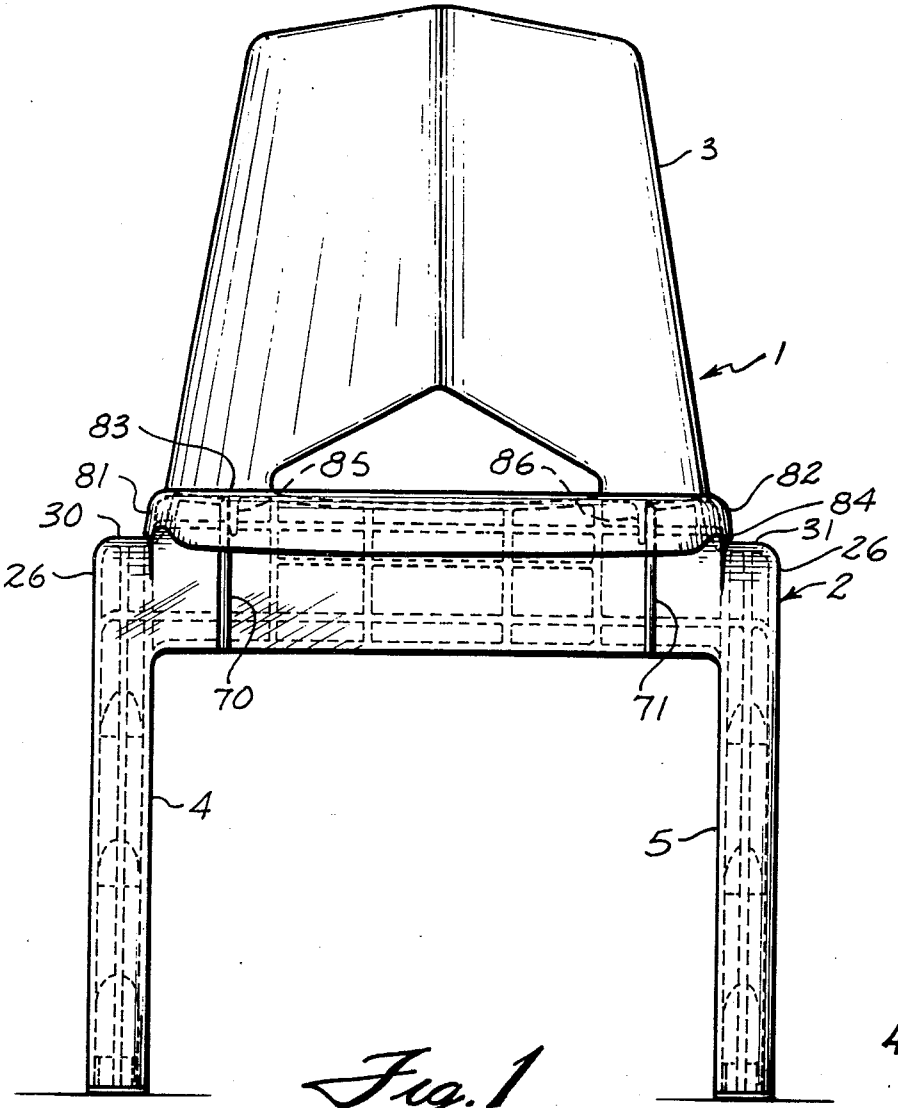
FIG. 1 is a front elevational view of a chair showing a first embodiment of the base of this invention.

Referring now to the drawings in detail and particularly to FIGS. 1 and 2 there is shown a chair 1 comprised of a base 2 and a unitary seat-back shell 3. Seat-back shell 3 can be of the type disclosed in my now issued U.S. Pat. No. 3,628,832, of Dec. 21, 1971, and claimed in my divisional application of that patent, which was filed on June 15, 1971.

Base 2 is advantageously of unitary construction and can be molded or cast from a relatively rigid plastic material for example, high density polypropylene containing a suitable colorant or pigment so it is unnecessary to paint the base after it is formed. The seat-back shell 3 is also advantageously of unitary construction and can be molded or cast from a relatively rigid plastic material for example, high density polypropylene containing a suitable colorant or pigment.

As is apparent with reference to FIGS. 1 and 2, both the base 2 and seat-back shell 3 are symmetrical about a vertical longitudinal plane passing through the center of the chair in a fore and aft direction.

As shown at FIGS. 1–4, base 2 has front legs 4 and 5 and rear legs 6 and 7. The legs are unitary with the centrally located upper seat supporting structure 8 which forms the upper portion of base 2. Supporting structure 8 includes an upper wall 9 which is generally rectangular and which merges smoothly with a sloping front skirt 10 of the base at a smoothly rounded front corner 11. There is also a sloping rear skirt 12 which merges smoothly with upper wall 9 at a rounded rear corner 13 of the base. As is apparent with reference to FIG. 2, upper wall 9 slopes slightly downwardly along its length between the front legs 4, 5 and rear legs 6, 7. Formed in the center of upper wall 9 is a rectangular opening 14.

Figure 4:
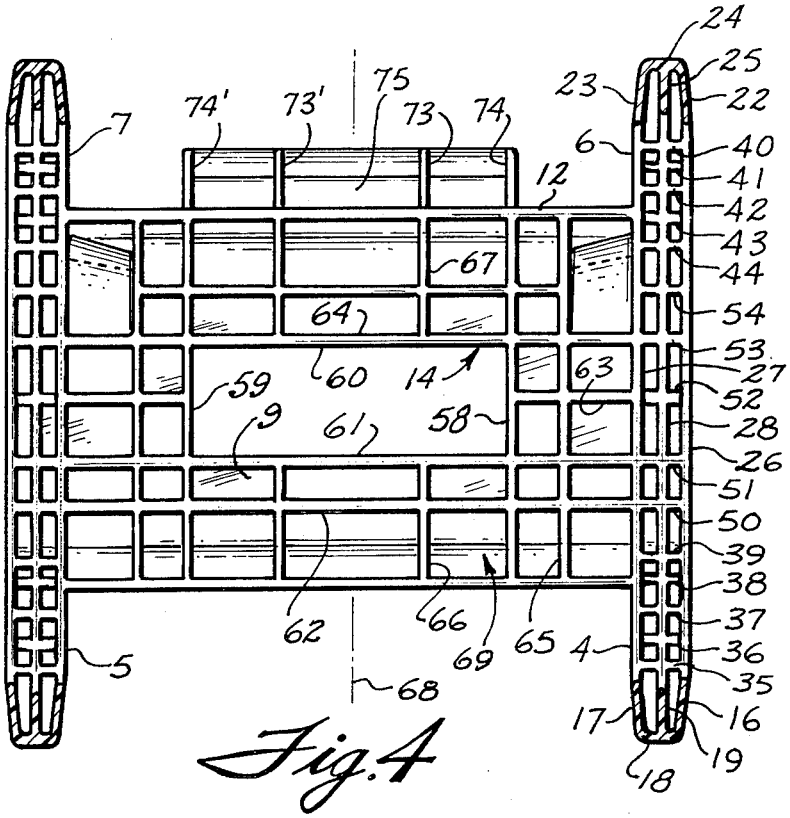
FIG. 4 is a view in section taken along line 4—4 of FIG. 2 and showing the bottom of the base in plan, with the seat removed.

With reference to FIG. 4, each leg has a generally downwardly opening U-shaped configuration and includes an outer wall 16, an inner wall 17, and a connecting wall 18 which integrally joins walls 16 and 17. The walls 16 and 17 are each of the same depth and thickness and diverge slightly relative to each other. Midway between walls 16 and 17, and integral with connecting wall 18 is an intermediate wall 19 which has a depth as measured from wall 18 which is somewhat less than the depth of the respective inner and outer walls 16 and 17.

As is alos apparent from FIG. 4, the leg 6 has a cross sectional configuration like that of leg 4 and includes an outer wall 22, an inner wall 23, a connecting wall 24 and an intermediate wall 25. Legs 4 and 6 are identical respectively to legs 5 and 7.

At each side of base 2 is a side skirt 26 and spaced inwardly from side skirt 26 is an inner skirt 27. There is also an intermediate skirt 28 which has a vertical height less than skirts 26 and 27. As is apparent with reference to FIGS. 2–4, outer skirt 26 forms a horizontal continuation of outer wall 16 of leg 4 and of outer wall 22 of leg 6. Similarly, inner skirt 27 forms a horizontal continuation of inner wall 17 of leg 4 and inner wall 23 of leg 6. Intermediate skirt 28 also forms a horizontal continuation of intermediate walls 19 and 25 of the respective legs 4 and 6. As is apparent with reference to FIGS. 2 and 3, a ledge 30 is formed at the top of outer skirt 26. This ledge 30 forms a continuation of the connecting walls 18 and 24 of the respective legs 4 and 6. The ledge 30 is spaced outwardly from upper surface 9 of the base and as shown at FIG. 2, is inclined downwardly toward the rear of the base at an angle relative to horizontal which is slightly greater than the angle of surface 9. Skirts 26 and 27 are the same height.

Legs 4 and 6 and ledge 30 lie in a common vertical plane or zone at one side of the base. The legs 5 and 7 at the other side of the base as well as the ledge 31 lie in a common vertical plane or zone which is parallel to that of the legs 4, 6 and ledge 30. Hence, legs 4 and 6 at one side of the chair do not diverge relative to legs 5 and 7 at the other side of the chair. However, legs 4 and 6 diverge relative to each other and similarly, legs 5 and 7 diverge relative to each other. This diverging relationship forms a significant feature of the stacking and nesting capabilities of this chair which will be discussed later in detail.

Front skirt 10 is coplanar with and forms a continuation of section 32 of the upper portion of connecting wall 18 of the legs 4 and 5 at a location below the respective ledges 30 and 31. In addition, rear skirt 12 is coplanar with and merges smoothly with the short section 33 of the connecting walls 24 of legs 6 and 7.

Figure 5:
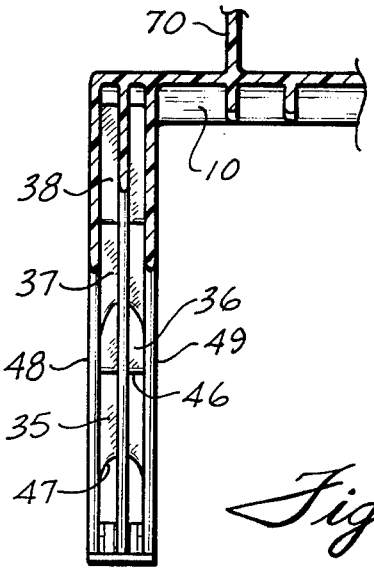
FIG. 5 is a partial view in section of one of the legs of the chair taken along line 5—5 of FIG. 2.
Figure 6:
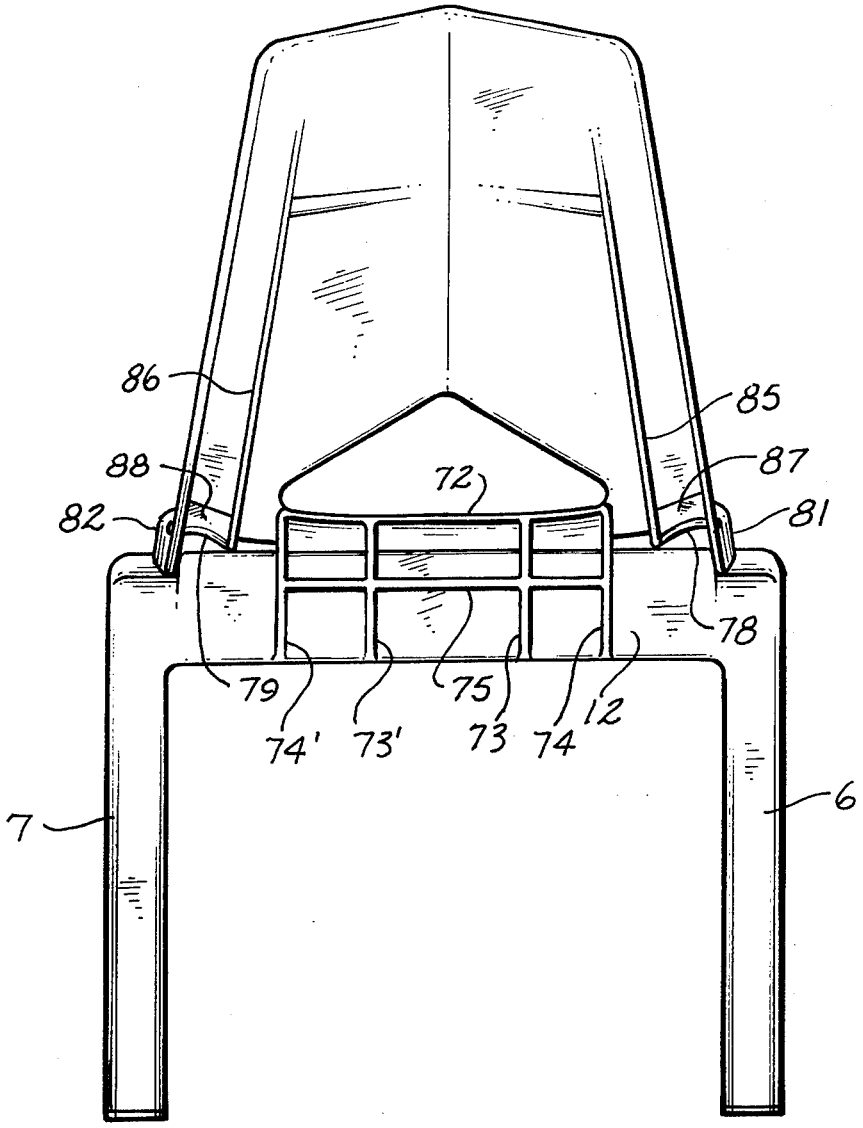
FIG. 6 is a rear view in elevation of the chair of FIG. 1.

Legs 4 and 5 each have a plurality of vertical strengthening webs or walls 35–39 and legs 6 and 7 have similar vertical strengthening webs or walls 40–44. Each of the webs 35–39 is integral with the respective walls 16–19 of the respective legs 4 and 5. As is apparent with reference to FIG. 2, webs 36 and 38 terminate at the inner edge 45 of intermediate wall 19. The termination is a horizontal edge 46 as shown at FIG. 5. Webs 35, 37, and 39, on the other hand, have a bottom edge 47 which curves downwardly to extend to the inner edges 48 and 49 of the outer wall and inner wall 16 and 17 respectively of the front legs. Rear legs 6 and 7 have webs 41 and 43 with horizontal edges whereas the bottom edges of the webs 40, 42 and 44 are curved. Each of the verticals webs and walls of the legs as well as the support structure of the base have rounded bottom edges like edge 128 of FIG. 11.

In the support structure section 8 of the base, within the confines of inner skirt 27 and outer skirt 26 are strengthening webs 50–54 (FIGS. 2 and 4). The webs 50, 51 53 and 54 curve downwardly from the bottom edge 55 of intermediate skirt 27 at their opposite sides and are integral respectively with the outer skirt 26 and inner skirt 27. Web 52 on the other hand, terminates at a horizontal bottom edge coplanar with the bottom edge 55 of skirt 27.

Figure 3:
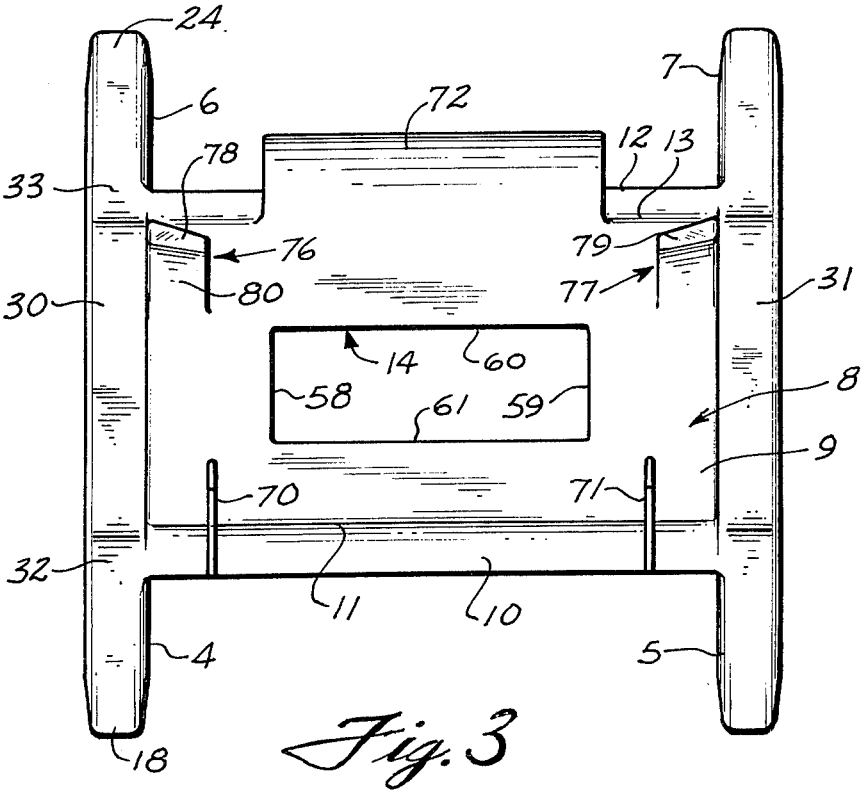
FIG. 3 is a top plan view of the base of the chair of FIG. 1 with the seat-back shell removed.

As shown at FIGS. 3 and 4, opening 14 at the center of support structure 8 is defined by vertical side walls 58 and 59, a vertical rear wall 60 and a vertical front wall 61. Between front skirt 10 and front wall 61 is a transversely extending reinforcing wall 62. Wall 62 is aligned with reinforcing web 50 and extends across the entire width of the base. Similarly, wall 61 is aligned with the web 51 and extends across the entire width of the base. Aligned with web 52 is a short transverse wall 63 which forms a continuation of the web 52 and terminates at side wall 58. Similarly, rear wall 60 of opening 14 is a continuation of web 53 and extends the entire width of the base. Between rear skirt 12 and wall 60 is a transverse wall 64 which extends only partially across the underside of the base. All the transverse walls are integral with upper wall 9 of the base.

Between inner skirt 27 and side wall 58 is a longitudinal wall 65 which extends from front skirt 10 to rear skirt 12 and is integrally joined to each of the transverse walls it intersects as well as to the upper wall 9 of the base. Similarly, side wall 58 has front and rear extensions such that this wall extends the distance between skirts 10 and 12 in a direction longitudinally of the base. There are also reinforcing walls 66 and 67 which are aligned with each other but which do not continue across opening 14. The short longitudinal walls 66 and 67 are in spaced relation to the longitudinal center line 68 of the base. As is apparent with reference to FIG. 4, the walls and webs are symmetrical about longitudinal center 68, and hence, the side of the chair including legs 5, 7 will not be explained in detail.

At each of the intersections of the longitudinally extending walls with the transversely extending walls, the respective walls are integrally joined to form the criss-cross pattern shown at FIG. 4. By virtue of this grid-work of criss-cross pattern both the legs as well as support structure 8 have substantial beam strength and resistance to bending and flexing. It will also be observed that the pockets such as pocket 69 formed between the respective vertical webs and walls of the support structure 8 and of the several legs and ledges of the base all open downwardly and terminate within the confines of the lower edges of the respective leg walls and skirts of the base. This provides an appealing profile since the strengthening walls and webs are not visible when the base is in its normal upright position as shown for example at FIGS. 1–3.

The webs 35–39, and 40–44, and 50–54 of each pair of legs are each parallel with each other and are advantageously vertical when the base is in its upright position. In addition, all the transversely extending walls within the confines of side skirts 27 and front and rear skirts 10 and 12 are either parallel with or form continuations of the webs in the legs. The longitudinal strengthening walls such as walls 65, 58, and 67 are perpendicular to the transverse walls and are in vertical planes. This arrangement of the webs facilitates forming base 2 by molding or casting by permitting the use of a single plug type mold piece to form the bottom surfaces of the base as well as all the strengthening webs and walls of the support structure and leg structures. By having all the webs extend in the same direction, for example, perpendicular to the floor on which the feet of the legs rest, a straight pull or draw is provided for the plug mold so the base can readily be removed from the mold plug after it is formed. The upwardly facing surfaces of the base such as the upper surface of wall 9, the outer surfaces of front skirt 10 and rear skirt 12 and the outer and upper surfaces of the respective walls of the legs, for example the walls 16–18 of leg 5 provide for readily removing the base from the female portion of the mold which defines these outer upwardly facing surfaces.

Seat-back shell 3 is secured to base 2 at several locations. With reference to FIG. 1, there are upstanding seat securing flanges 70 and 71 which are parallel to each other and which are spaced inwardly from the sides of the base. The flange 70 forms a continuation of the longitudinal reinforcing wall 65 of the base and the flange 71 forms a continuation of the corresponding longitudinal wall at the other side of the base. As is apparent with reference to FIG. 2, each flange projects above upper wall 9 and terminates at a location forwardly of the transverse center of the base. At the rear of the base is a centrally located curved support pad 72 which has a top surface with a curvature conforming to the curvature of the underside of the rear of the seat portion of the seat-back shell 3. This support pad takes the form of a wall which has a width essentially equal to the width of the opening 14 and is supported by integral gusset shaped reinforcing webs 73, 73′, 74 and 74′ which are beneath the pad 72. Additional strength is provided for the gusset webs by a horizontal transversely extending reinforcing wall 75. As is apparent with reference to FIGS. 2 and 3 support pad 72 projects rearwardly of rear skirt 12 and merges into upper wall 9 of the support structure.

Projecting upwardly from the base at locations on opposite sides of support pad 72 are two additional support pads 76 and 77. These support pads have rearwardly facing sloping surfaces 78 and 79 respectively which also slope slightly inwardly to engage transverse connecting flanges at the underside of the seat. Each of pads 76 and 77 also has a sloping top wall 80 which conforms to the curvature of and engages the underside of the seat.

Seat-back shell 3 has a peripheral flange including the downturned side flanges 81 and 82 (FIGS. 1 and 2) which extend respectively along the sides of the seat portion 83 of the seat-back shell 3. The bottom edges of these flanges seat on the top surfaces of ledges 30 and 31 respectively at locations closely adjacent upper side walls 84 of the base. In addition, the seat has a pair of longitudinally extending connecting flanges 85, 86 which are of lesser depth than the side flanges and which parallel the side flanges along the underside of the seat. Adjacent the juncture of the seat 83 with the back there are transverse connecting flanges 87 and 88 at each side of the seat which are integral with and extend between the side flanges and connecting flanges.

To secure the seat to the base the seat is first positioned on the base with the bottom edges of the side flanges engaging the top surfaces of ledges 30, 31 and the transverse connecting flanges 87 and 88 engaging the rearwardly facing surfaces 78 and 79 of the respective pads 76 and 77. The connecting flanges 70 and 71 of the base are so disposed relative to the front of the longitudinally extending connecting flanges 85 and 86 of the seat that the flanges engage the inner surfaces of the respective base flanges 70 and 71.

The securing of the seat to the base is accomplished by ultrasonically welding the material of the longitudinally extending flanges 85, 86 of the seat to the respective flanges 70 and 71 of the base, a process which is simply accomplished by engaging either the seat flange or the base flange with the ultrasonic welding tool and providing a back-up implement to support the other flange during welding. In addition, the transverse flanges 87 and 88 of the seat are ultrasonically welded to the rearwardly facing walls 78 and 79 of the respective pads 76 and 77. Such ultrasonic bonding can be done with the tool shown and described in U.S. Pat. No. 3,607,580. By virtue of the additional support provided, by the curved rear pad 72 where it engages the undersurface of the seat, by the surfaces 80 of the pads 76 and 77 where they engage the curved bottom of the seat, and by the engagement of the bottom edges of the side flanges of the seat with the ledges of the base, the seat is rigidly connected to the base.

In order to form the curved seat support pad 72 and the upwardly projecting supporting pads 76 and 77, it is necessary to use a third plug type mold element which is movable transversely of the bottom plug and top cavity portion of the mold used to form the chair of the embodiments of FIGS. 1–6. Formed in the movable plug are the necessary recesses to form the wall 75 as well as the reinforcing gussets 73–74′ and rear portions of the pads 76 and 77. As will subsequently become apparent, the second embodiment of the chair of this invention as shown at FIGS. 7 and 8 does not require such a three piece mold to form the chair base.

Figure 8:
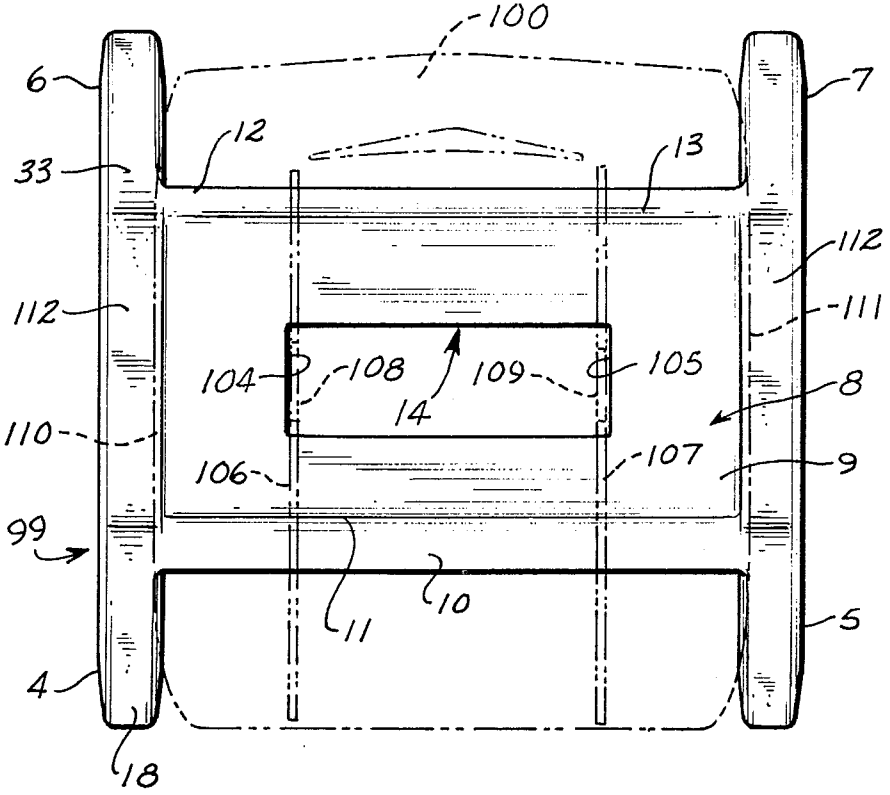
FIG. 8 is a top plan view of the chair of FIG. 7 showing the seat in phantom lines for purposes of clarity.
Figure 7:
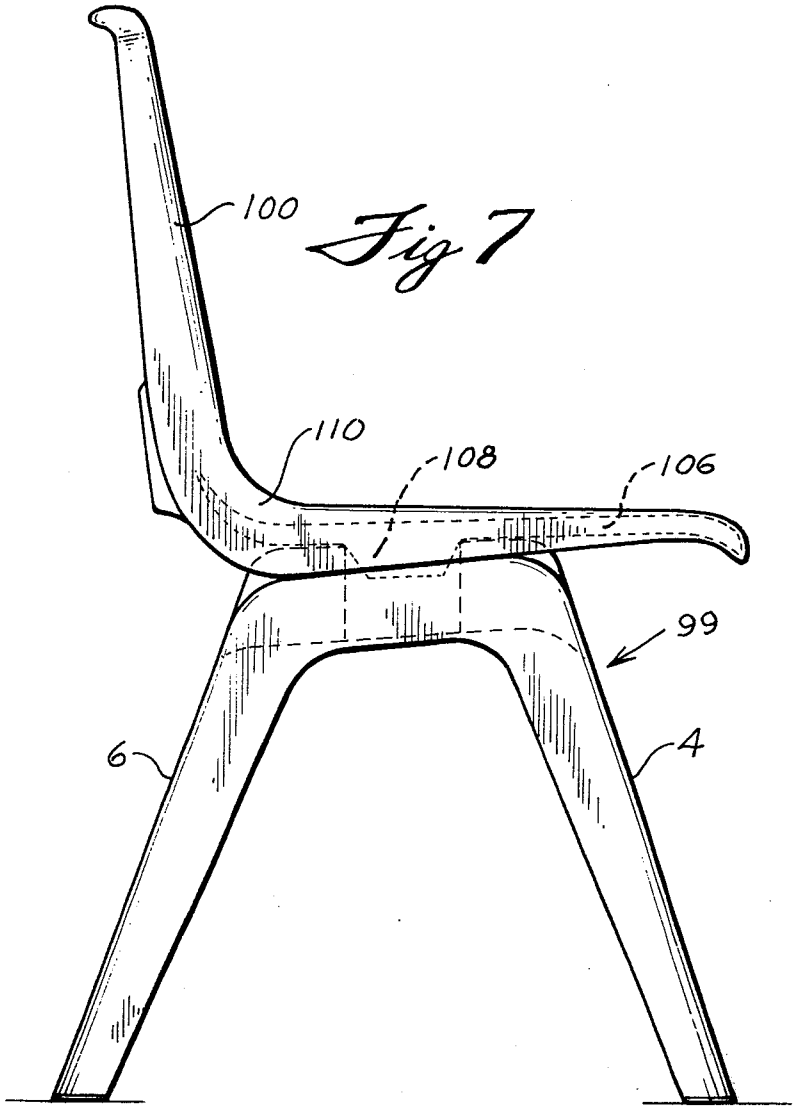
FIG. 7 is a side view in elevation of a second embodiment of a chair according to this invention.

With reference to FIGS. 7 and 8 a second embodiment of a base and seat-shell will now be explained. In this second embodiment, the base 99 is similar to the base 2 of the embodiment of FIGS. 1–5, but does have differences to accommodate a seat-back shell 100 of a different construction. In the embodiment of FIGS. 7 and 8 flanges 70 and 71 as well as support pads 72, 76 and 77 are eliminated so the top of the base has the configuration shown at FIG. 8. The leg structure of the base of this embodiment is identical to that described for the base 2 and the strengthening web arrangement at the under side of the base is essentially identical save that the transverse reinforcing wall 64 is continuous from one side of the base to the other and forms a continuation of the webs 54 at the ledge portion of the base.

As will be observed with reference to FIGS. 7 and 8, the supporting gussets 73, 73′, 74 and 74′ as well as horizontal wall 75 are eliminated from this embodiment. An advantage of the embodiment of FIGS. 7 and 8 is that the entire base can be formed in a simple two-piece mold by forming the upwardly facing surfaces of the base in the cavity portion of the mold and by forming the strengthening webs, insides of the legs, and transverse and longitudinal reinforcing ribs with suitable openings in the plug portion of the two-piece mold. A suitable parting plane for this arrangement would be along the lower edge of the outer wall of the legs and along the lower edge of the front and rear skirts.

In the embodiment shown at FIGS. 7 and 8, the side walls 104 and 105 defining opening 14 of the base form the structure for securing the seat-back shell to the base. The seat-back shell can be of the type disclosed in my copending application Ser. No. 198,175, filed Nov. 12, 1971 and which has a pair of horizontal flanges 106 and 107 extending longitudinally of the seat along its underside and which curve upwardly to extend a short distance along the rear of the back of the seat. The downwardly projecting connecting flange portions 108, 109 are spaced apart a distance to engage the inner surfaces of the walls 104 and 105 of the base when the seat-back shell 100 is mounted on the base. The seat-back shell of this embodiment has side flanges 110 and 111 which are so configured that the bottom edges of these flanges seat on the top surfaces of the base ledges 112 when the seat is positioned on the base. Securing the seat to the base is a simple matter which merely requires ultrasonically welding the connecting flanges 108 and 109 of the seat to the side walls 104 and 105 of the opening 14.

Of course, both the material of the seat as well as the material of the base is a plastic material which is capable of being ultrasonically welded. The chair of FIGS. 7 and 8 can be easily stacked as shown in application Ser. No. 198,175.

In view of the foregoing description it is apparent that two embodiments of a base of unitary construction have been provided which are formed wholly from a plastic material and which do not require separate bracing or reinforcing. As a result, the respective chairs are formed from only two pieces each of which is of unitary construction and can be cast or molded in relatively simple molds.

While in the embodiment of FIGS. 1–6, the connecting flanges 70 and 71 as well as the support pads 72, 76 and 77 are shown as integral with the base 2, these connecting elements can, of course, be separately formed and then secured to a base structure like base 99 of the embodiment of FIGS. 7 and 8. In addition, the arrangements for securing the seat-back shell to the base can be varied to suit the structure of the attaching flanges or other attaching means of the seat-back shell.

Figure 10:
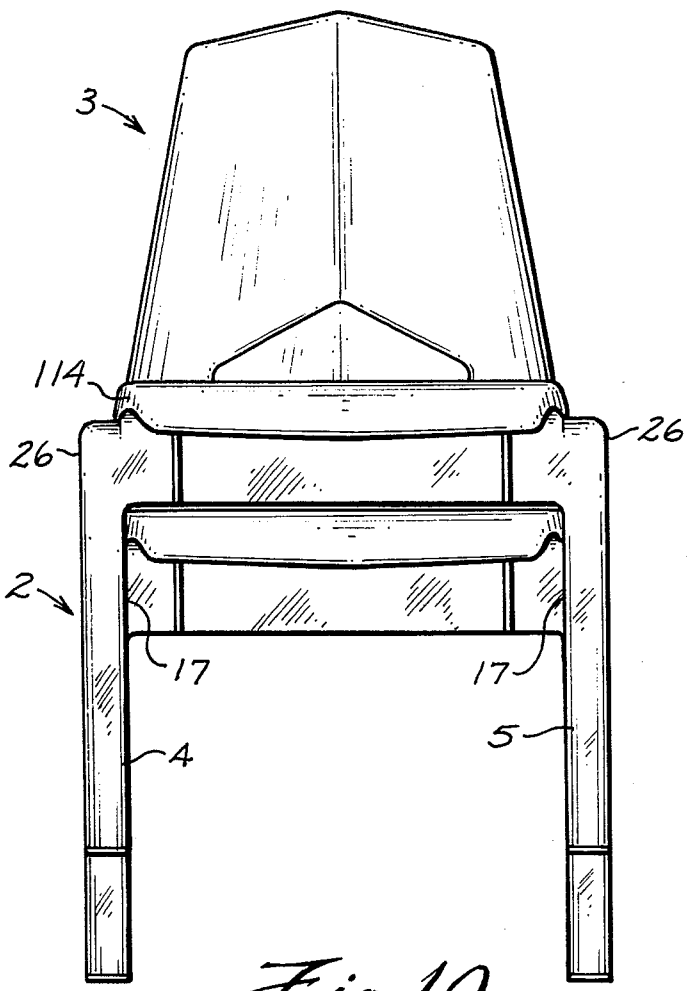
FIG. 10 is a front view in elevation of the stacked chairs of FIG. 9.
Figure 9:
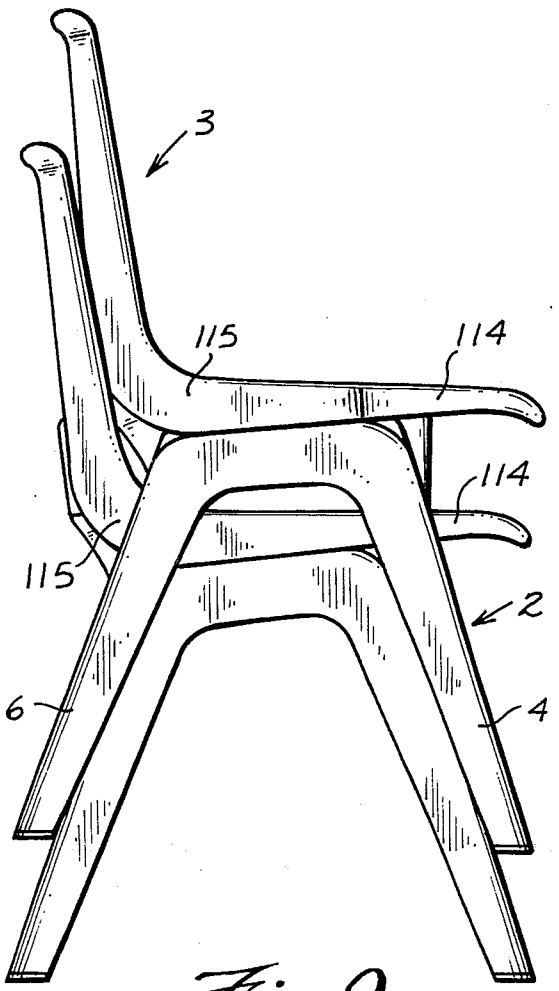
FIG. 9 is a reduced size side view in elevation of several of the chairs of FIGS. 1–6 in stacked nested relation to each other.

FIGS. 9 and 10 show the manner in which a chair of the embodiment of FIGS. 1–6, previously described, can be stacked in nested relation for shipping or storage. It is to be noticed that the width of the base as measured between the outer skirts 26 is somewhat greater than the width of the seat. In addition, forward portions 114 of the side flanges of the seat converge at a location near the front of the seat whereas toward the back of the seat rear portions 115 of flanges converge slightly before extending upwardly along the back of the seat. As a result, even though a major portion of the side flanges of the seat rest on the respective ledges 30 and 31 at the sides of the base, the seat has front and rear portions which are narrower than the distance between the legs 4, 6 at one side of the chair and the legs 5, 7 at the other side of the chair as measured between the respective inner walls 17 and 23. As a result, the chairs can be stacked in nested relation as shown at FIGS. 8 and 9 so they occupy only a minimum space for shipping and storage.

Figure 11:
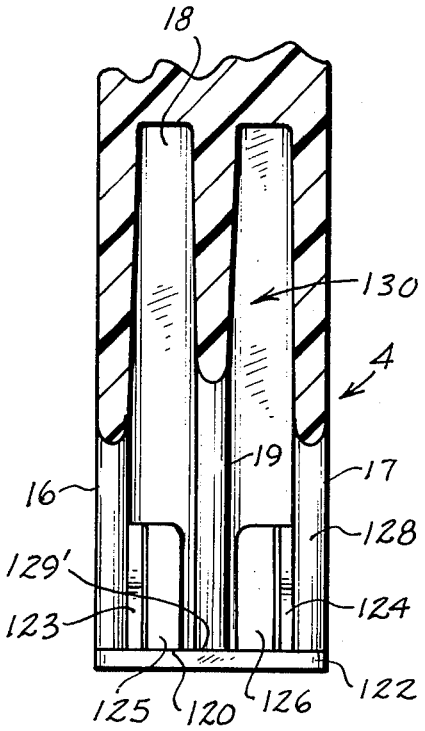
FIG. 11 is an enlarged partial view of the inside of the foot of a leg, taken along line 11—11 of FIG. 2, and showing a glide arrangement in accordance with this invention.
Figure 12:
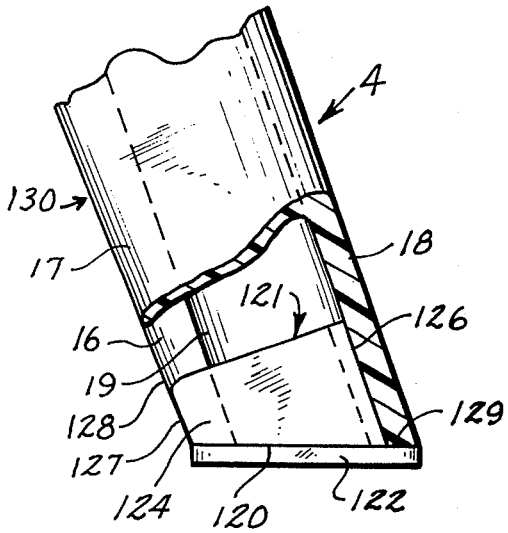
FIG. 12 is a partial view in side elevation with portions cut away, of the glide arrangement of FIG. 11.

An additional feature of this invention which facilitates use of the two embodiments described in institutions of various types where chairs of several different heights may be required, without the need for different molds to form the bases for the chairs, resides in a unique glide arrangement for the legs of the base. With reference to FIGS. 11 and 12, there is shown the glide arrangement according to this invention. As previously described for leg 4, the leg has an outer wall 16, an inner wall 17, a connecting wall 18 and an intermediate wall 19. These walls are continuous to the bottom edge 120 of the leg. The sloping leg 4 is, of course, cut at an angle so the bottom edge 120 is substantially horizontal. A plastic material glide 121 of unitary construction has a bottom base or pad 122, a pair of side walls 123 and 124 which project upwardly from base portion 122, and a pair of inclined end walls 125 and 126 aligned with each other and which are integral respectively with the side walls, and are also integral with pad 122. As shown at FIGS. 10 and 11, front walls 125 and 126 slope at the same angle of inclination as connecting wall 18 of the leg relative to bottom edge 120. In addition, side walls 123 and 124 have sloping end edges 127 which follow the inner edges 128 of the respective side walls 16 and 17 of the chair leg. As is apparent with reference to FIGS. 10 and 11, base pad 122 projects beyond the respective walls 123–126 to provide an upwardly facing peripheral flange 129 along three sides of the glide which is engaged by and supports the bottom edge 120 of the leg. In addition, since the walls 125 and 126 are spaced apart to accommodate intermediate wall 19, the bottom edge 129' of this intermediate wall also rests on the top surface of pad 122, but at a location within side walls 123 and 124 of the glide.

It will be observed from FIGS. 11 and 12 that by virtue of the open side 130 of the chair leg between the walls 16 and 17, an ultrasonic welding tool can be inserted into glide 121 to ultrasonically weld the walls of the glide to one or more of the walls of the leg. Correspondingly, this side wall construction of the leg provides the additional advantage that a tool can be inserted to accomplish such ultrasonic welding. Advantageously, the glide 121 can be welded to the connecting wall 18 at two locations by applying the tool to the inside of the walls 125 and 126, and the side walls 123 and 124 of the glide can be ultrasonically welded to the side walls 16 and 17 of the leg by similarly applying the ultrasonic tool to the inside surfaces of the side walls of the glide.

It will correspondingly be apparent that chairs of at least several different heights can be provided merely by cutting the legs 4–7 in a common horizontal plane, then inserting a glide 121 into the bottom of each leg, and then ultrasonically welding the side and the end walls of the glide to the side walls of the legs. By virtue of the abutting engagement of the bottom edge of the leg with the base pad 122 of the glide no substantial stresses are created in the glide even when a heavy load is placed on the chair.

While the chair of this invention has numerous uses it is used with primary advantage in institutions of various types where chairs with exceedingly good sanitary characteristics and which readily lend themselves to sterilizing and cleaning are required. Because the height of the resulting chair can be adjusted, by severing the legs of the base and inserting and securing an appropriate glide to each leg, chairs of different heights can be readily provided from a single molded or cast base.

By adding a suitable colorant to the plastic material used to form the base as well as the seat-back shell, various colors of noncontaminating and nonpeeling finishes can be provided for the chair. Correspondingly, it is apparent that applicant has provided two embodiments of a base of unitary construction, and a seat-back shell of unitary construction so the resulting chair is in reality formed from two pieces which are ultrasonically welded together. Of course, the seat can be connected to the base with metal fasteners such as rivets if desired.

While two preferred embodiments of a chair in accordance with the invention have been shown and described in detail, and while the details of a particular glide arrangement have also been shown and described in detail, it is to be understood that numerous changes can be made without departing from the scope of this invention as set forth herein and as described in the appended claims.

What is claimed is:

1. A supporting leg and floor engaging glide arrangement comprising, in combination:

a unitary plastic material leg comprising
- a side wall structure generally of U-shape having an open side, and
- an end edge generally transverse to the side wall structure and parallel to the floor engaged by the glide; and a rigid unitary plastic material glide comprising
- a base portion of essentially uniform thickness having a bottom face adapted to rest on the floor;
- a hollow side wall structure projecting upwardly from said base portion and of a dimension to fit the end of the supporting leg;

said base having a top face parallel to the bottom face and being continuous across and engaging the end edge of the leg;

said side wall structure of said glide having flat surfaces parallel with and engaging surfaces of the side wall structure of the leg adjacent the end of the leg on which the glide is mounted, and the end edge engaging the top face of the base;

the side wall structure of the leg to which the glide is attached includes
- first and second spaced apart side walls, and
- a connecting wall extending between and joining said first and second walls,
- said first and second walls defining the open side of the leg between exposed side edges thereof;

said side wall structure of said glide includes
- a first wall projecting upwardly from said base portion, and
- a second wall projecting upwardly from said base portion in spaced relation to said first wall;

said first and second walls of said glide have exterior surfaces engaging the inside surfaces of said first and second walls of said leg at a location adjacent the end of said leg; and bonding means for bonding surfaces of the glide side wall to the leg side wall and including a weld through said first and second walls of said glide and leg.

2. A leg and glide arrangement according to claim 1 wherein the leg to which the glide is attached further includes a longitudinal strengthening rib projecting from the connecting wall into the space between said pair of spaced apart side walls; and said glide further includes spaced apart upright walls engaging the connecting wall of the leg at locations on opposite sides of said strengthening rib.

* * * * *